United States Patent [19]

Wang

[11] Patent Number: 4,942,790

[45] Date of Patent: Jul. 24, 1990

[54] PIPE WRENCH

[76] Inventor: Bor J. Wang, 3 Fl., No. 740, Chung Cheng Rd., Yung Ho City, Taipei Hsien, Taiwan

[21] Appl. No.: 412,485

[22] Filed: Sep. 26, 1989

[51] Int. Cl.[5] ..... B25B 13/12

[52] U.S. Cl. ..... 81/133

[58] Field of Search ..... 81/129.5, 133

[56] References Cited

U.S. PATENT DOCUMENTS

| | | | |
|---|---|---|---|
| 1,386,433 | 8/1921 | Shaw | 81/133 |
| 2,069,582 | 2/1937 | Justice | 81/133 |
| 4,561,330 | 12/1985 | Chen | 81/133 X |
| 4,597,315 | 7/1986 | Chen | 81/133 X |

*Primary Examiner*—James G. Smith

*Attorney, Agent, or Firm*—Rogers, Howell & Haferkamp

[57] ABSTRACT

A pipe wrench includes a handle, a seat pivotally fixed at the front end of the handle by a ratchet wheel, and a head slidable in said seat. A pawl with two teeth is pivotally fixed between the ratchet wheel and the handle so that the teeth of the pawl are engagable with the ratchet wheel. A rack is formed on the lower surface of the head for engaging with the ratchet wheel so that the head can be extended or retracted by the rotation of the ratchet wheel or by the rocking of the handle relative to the seat and the head. A spring is fixed at one end to one end of the slot and at the other end to the seat.

3 Claims, 4 Drawing Sheets

PIPE WRENCH

FIELD OF THE INVENTION

The present invention relates to a pipe wrench, and more particularly to a pipe wrench which has a ratchet wheel for controlling the extension or the retraction of the head of the pipe wrench.

BACKGROUND OF THE INVENTION

The retraction or extension of a head of a conventional pipe wrench requires the rotation of a control ferrule, or the like, manually using the fingers. This is a very slow process because the arm of force provided by the control ferrule is very short. Therefore, the head can not be retracted or extended quickly. In addition, the head of the pipe wrench can retract inadvertently resulting in possible injury to the user.

The present invention has arisen to mitigate and/or obviate the afore-described disadvantages of the conventional pipe wrench.

SUMMARY OF THE INVENTION

The primary objective of the present invention is to provide a pipe wrench, the head of which can be extended and retracted quickly and easily.

Another objective of the present invention is to provide a pipe wrench which also acts as an ordinary wrench such as a socket wrench.

The present invention seeks to provide a pipe wrench which includes a handle, a seat pivoted at the front end of the handle by a ratchet wheel, and a head slidable in said sheet. A pawl with two teeth is pivotally fixed between the ratchet wheel and the handle so that the teeth of the pawl are engagable with the ratchet wheel. A rack is formed on the lower surface of the head for engaging with the ratchet wheel so that the head can be extended or retracted by the rotation of the ratchet wheel or by the rocking of the handle relative to the seat and the head. A spring is fixed at one end to one end of the slot and at the other end to the seat.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
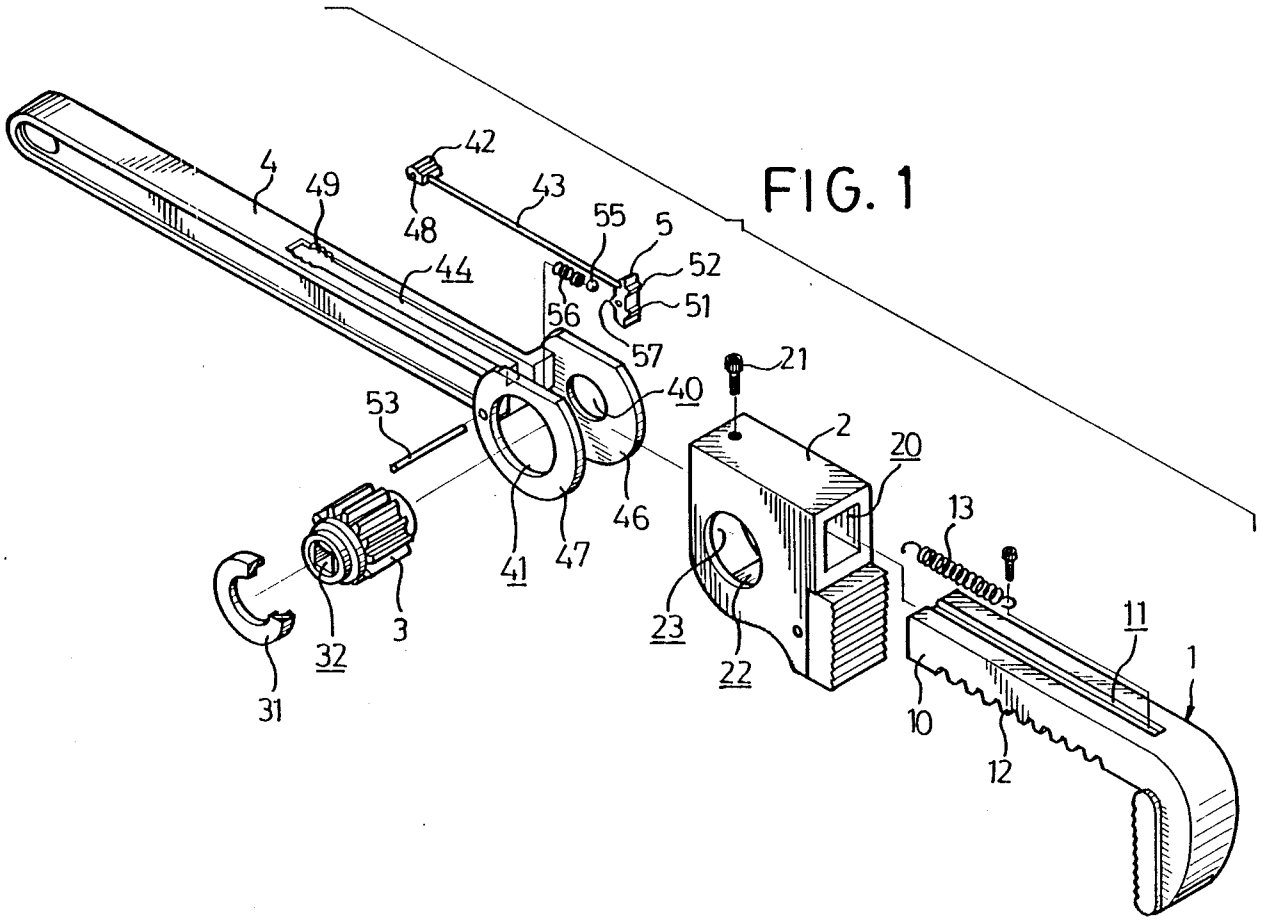
FIG. 1 is an exploded view of a pipe wrench in accordance with the present invention.
Figure 2:
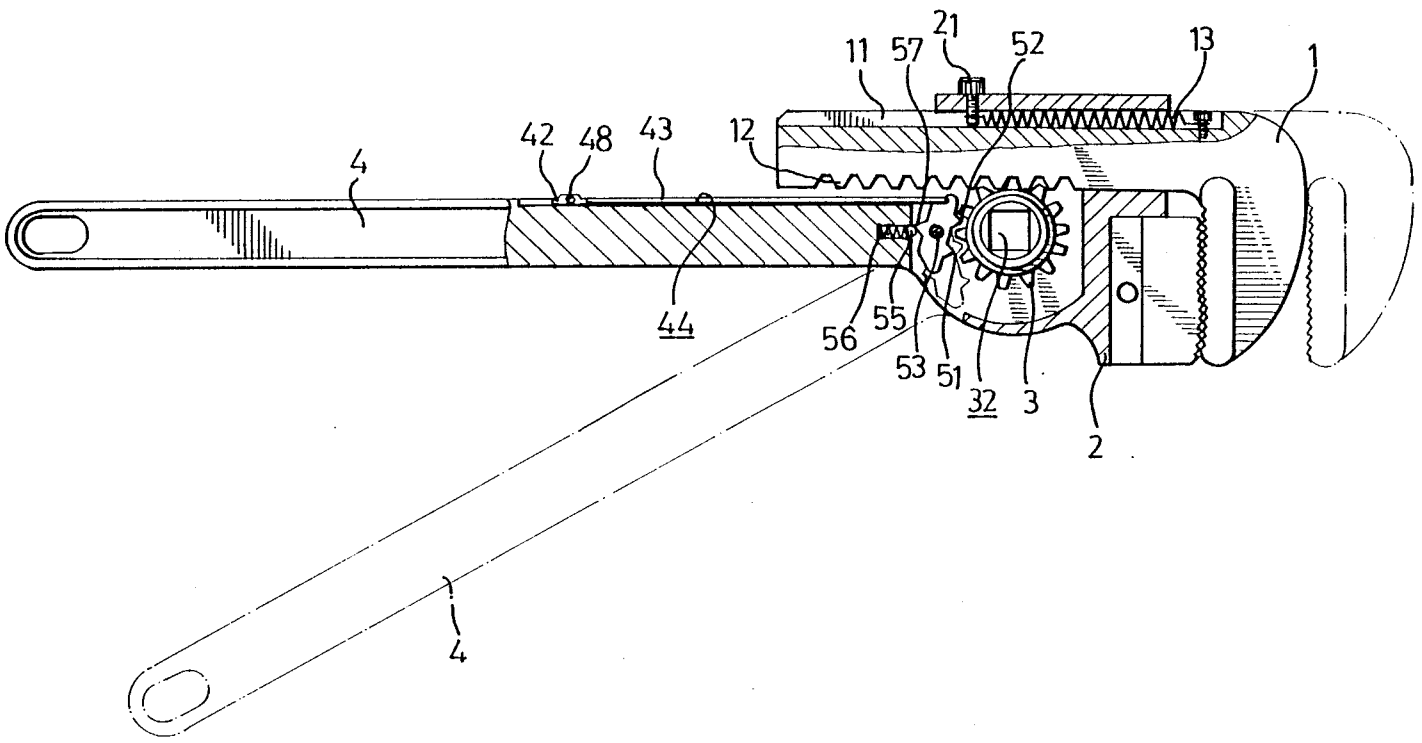
FIG. 2 is a cross sectional view of the pipe wrench of FIG. 1.

Referring to the drawings and initially to FIGS. 1 and 2, a ratchet pipe wrench in accordance with the present invention comprises generally a head 1, a seat 2, a ratchet wheel 3 and a handle 4.

The head 1 is substantially L-shaped with a longitudinal slot 11 and a rack 12 respectively formed on the upper and the lower surfaces of a lateral leg 10 of the head 1. A spring 13 is disposed in the slot 11 with one end thereof fixed to one end of the slot 11. A longitudinal hole 20 and a lateral hole 22 are formed in the seat 2. The lateral leg 10 of the head 1 is slidably received in the longitudinal hole 20 of the seat 2. An other end of the spring 13 is fixed to the seat 2 by means of a screw 21 or the like so that the spring force of the spring 13 always acts to retract the head 1 backward to the seat 2. A rear portion 23 of the seat 2 is empty.

A hole 32 is formed in each end of the ratchet wheel 3. The holes 32 are suitable for receiving a socket in order to act as a socket wrench. Alternatively, a wrench opening, such as a hexagonal opening (not shown) can be formed and substitute for the hole 32 so as to act as a closed head wrench. A pair of end plates 46, 47 each with a hole 40, 41 are disposed on the front end of the handle 4 for receiving the seat 2 therebetween. The ratchet wheel 3 is inserted in series through the holes 41, 22 and 40 and retained on the inner end by the hole 40. A retaining ring 31 is forcibly fitted on the outer end of the ratchet wheel 3 so that the ratchet wheel 3 is pivotal and rotatably engages with the rack 12 of the head 1. The head 1 thus can be extended or retracted by the rotation of the ratchet wheel 3. A cavity is formed in the front end of the handle 4 between the end plates 46, 47 and extended substantially along a longitudinal axis thereof for receiving a spring 56 and a ball 55 in series (FIG. 2). A pawl 5 with two teeth 51, 52 is pivotally fixed in front of the ball 55 by a pin 53. A protrusion 57 is formed on the rear end of the pawl 5 for engaging with the ball 55. A groove 44 with three position recesses 49 at one end thereof is formed on the upper end of the handle 4 for receiving a push button 42 and an extension rod 43. The extension rod 43 connects between the push button 42 and the upper end of the pawl 5 so that the pawl 5 can be rotated by the push button 42 thus bringing either tooth 51 or 52 of the pawl 5 into engagement with the ratchet wheel 3. A protuberance 48 is provided on both sides of the push button 42 for engagement into the three position recesses 49 so that the push button 42 and the pawl 5 have three selectable fixed positions.

Referring again to FIG. 2, the push button 42 is pushed to a foremost position and the tooth 52 of the pawl 5 is pushed into engagement with the ratchet wheel 3. At this position, the ratchet wheel 3 is freely rotatable clockwise but can not rotate counterclockwise. Relatively, when pressing down the handle 4, the ratchet 3 does not move. On the contrary, when pulling up the handle 4, the ratchet wheel 3 is allowed by the tooth 52 to rotate clockwise thus pushing the head 1 forward. Therefore, the head 1 can be extended by repeatedly rocking the handle 4.

Figure 3:
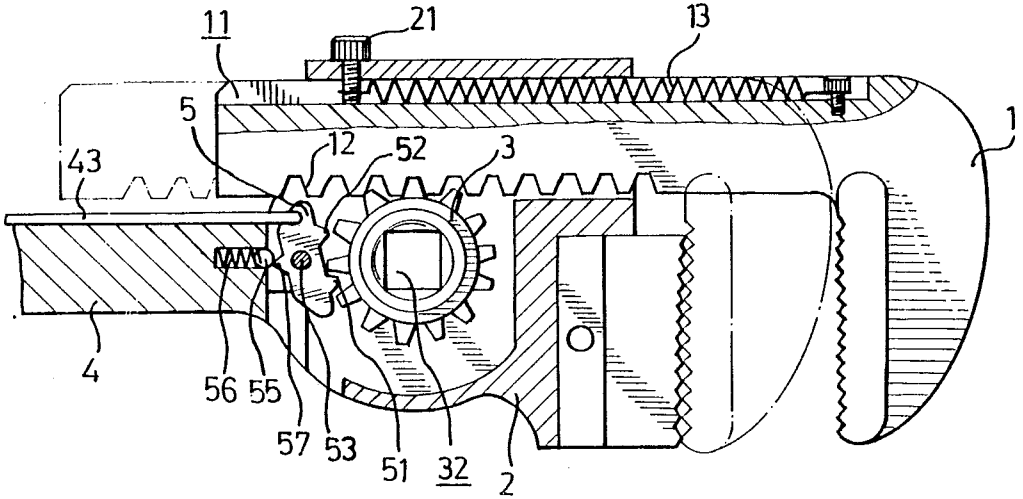
FIG. 3 is a partial cross sectional view similar to FIG. 2 with part of the handle removed.

Referring next to FIG. 3, the push button 42 is pushed rearward and the tooth 51 is pushed into engagement the ratchet wheel 3. At this position, the ratchet wheel 3 can freely rotate counterclockwise but can not rotate clockwise. Relatively, the rocking of the handle 4 causes the ratchet wheel 3 to rotate counterclockwise thus retracting the head 1.

Figure 4:
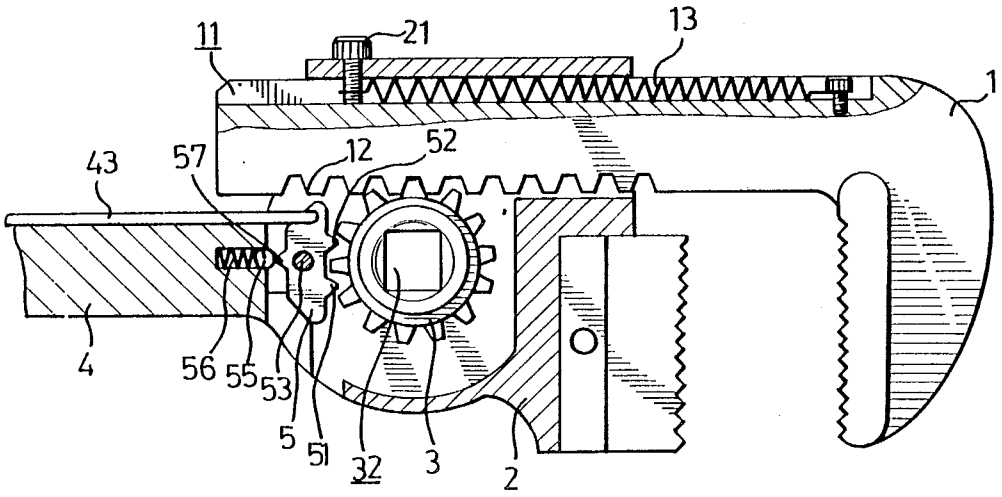
FIG. 4 is a partial cross sectional view similar to FIG. 3, illustrating a locked position of the wrench.

Referring next to FIG. 4, the push button 42 and the pawl 5 are in the respective middle positions. At this position, the ratchet wheel 3 is locked by the pawl 5, i.e., the ratchet wheel 3 can not rotate. Therefore, the inadvertent extension or retraction of the head 1 can be prevented.

Accordingly, the present invention has the following advantages:

(a) The head 1 can be extended or retracted quickly by means of the handle 4 because the arm of force of the handle is relatively longer.

(b) The spring 13 facilitates the retraction of the head 1.

(c) The openings 32 can receive a socket or the like to act as an ordinary wrench.

(d) The ratchet wheel 3 can be locked by the pawl 5 so that the inadvertent extension and retraction of the head 1 can be prevented.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A pipe wrench comprising a handle, a pair of end plates each with a hole being provided at a front end of said handle, a cavity being formed in said front end for receiving a spring and a ball, and a groove with three position recesses being formed on an upper surface of said handle for receiving a button and a rod; a pawl with two teeth being pivotally fixed in front of said ball; a seat with a transverse hole and a longitudinal hole being pivotally fixed between said end plates of said handle by a ratchet wheel, said ratchet wheel extending through said holes of said end plates and said transverse hole of said seat; and a head with a rack formed on a lower surface thereof being slidably provided in said longitudinal hole of said seat, said rack of said head engaging with said ratchet wheel so that said head can be extended or retracted by a rotation of said ratchet wheel.

2. A pipe wrench according to claim 1, wherein a slot is formed on a upper surface of said head for receiving a second spring, said second spring being fixed at one end to one end of said slot and at an other end to said seat.

3. A pipe wrench according to claim 1, wherein an opening is formed in a center of said ratchet wheel for receiving a socket or the like.

* * * * *